United States Patent [19]

Schmitz

[11] 4,285,092

[45] Aug. 25, 1981

[54] BOTTOM PLATE FOR A CARPET POWER CLEANER

[75] Inventor: Hans Schmitz, Wuppertal, Fed. Rep. of Germany

[73] Assignee: Vorwerk & Co. Interholding GmbH, Wuppertal, Fed. Rep. of Germany

[21] Appl. No.: 85,514

[22] Filed: Oct. 17, 1979

[30] Foreign Application Priority Data

Oct. 23, 1978 [DE] Fed. Rep. of Germany ... 7831493[U]

[51] Int. Cl.[3] ..... A47L 9/06

[52] U.S. Cl. ..... 15/378; 15/422

[58] Field of Search ..... 15/377, 378, 422

[56] References Cited

U.S. PATENT DOCUMENTS

| | | | |
|---|---|---|---|
| 2,785,431 | 3/1957 | Pardee | 15/378 X |
| 3,120,021 | 2/1964 | Pauler et al. | 15/377 |
| 3,286,296 | 11/1966 | Waters | 15/422 |
| 4,167,801 | 9/1979 | Erbor et al. | 15/377 X |

FOREIGN PATENT DOCUMENTS

| | | | |
|---|---|---|---|
| 851462 | 10/1960 | United Kingdom | 15/377 |

*Primary Examiner*—Christopher K. Moore
*Attorney, Agent, or Firm*—Michael J. Striker

[57] ABSTRACT

A bottom plate for a carpet power cleaner has a body part, detents provided on the body part and detachably engageable in a housing of a carpet power cleaner. The detents may be of one piece with the body part. The detents may extend through cutouts provided in a lower wall of the housing so as to engage with the latter. The detents may have bent end sections which are engageable with detent edges located downstream of the cutouts of the housing. The body part may have a rear edge provided with inwardly extending flanging.

9 Claims, 3 Drawing Figures

BOTTOM PLATE FOR A CARPET POWER CLEANER

BACKGROUND OF THE INVENTION

The present invention relates to a bottom plate for a carpet power cleaner. More particularly, it relates to such a bottom plate which is removably mounted on a carpet power cleaner.

Removable bottom plates for carpet power cleaners are known in the art. These bottom plates are constituted of steel sheet or similar material. The bottom plates must be mounted removably, inasmuch as so-called round brushes provided in carpet power cleaners tend to wear and must be exchanged by a user. For this purpose, the known bottom plates are mounted on the housing of the carpet power cleaner by means of screws. These screws are so constructed as to allow the user to unscrew them without the utilization of a tool, for example by a coin. The above-mentioned mounting with the aid of special screws is widely utilized; however, it is very expensive.

SUMMARY OF THE INVENTION

Accordingly, it is an object of the present invention to provide a bottom plate for a carpet power cleaner, which avoids the disadvantages of the prior art.

More particularly, it is an object of the present invention to provide a bottom plate for a carpet power cleaner, which can be mounted on the carpet power cleaner in a simple and inexpensive manner.

In keeping with these objects and with others which will become apparent hereinafter, one feature of the present invention resides, briefly stated, in a bottom plate which is provided with detents arranged to engage in a housing of a carpet power cleaner.

In such a construction, the bottom plate can be easily mounted on the housing of the carpet power cleaner by engagement of the detents into the housing. This mounting is detachable so that the bottom plate can be easily removed from this housing when needed. The above-described connection of the bottom plate with the housing of the carpet power cleaner has a simple and inexpensive construction.

In accordance with a further advantageous feature of the present invention, the detents are of one piece with the bottom plate. This further simplifies the inventive construction of the bottom plate.

Still another feature of the present invention is that the housing of the carpet power cleaner has slots in its lower wall, and the above-mentioned detents project outwardly from the bottom plate and extend through these slots.

A further feature of the present invention is that the detents are provided with the bent end sections which engage with detent edges arranged behind the slots of the housing of the carpet power cleaner.

Finally, a further feature of the present invention is that the bottom plate has a rear edge and is provided with a flanging on this rear edge.

The novel features which are considered as characteristic for the invention are set forth in particular in the appended claims. The invention itself, however, both as to its construction and its method of operation, together with additional objects and advantages thereof, will be best understood from the following description of specified embodiments when read in connection with the accompanying drawings.

DESCRIPTION OF THE PREFERRED EMBODIMENT

Figure 1:
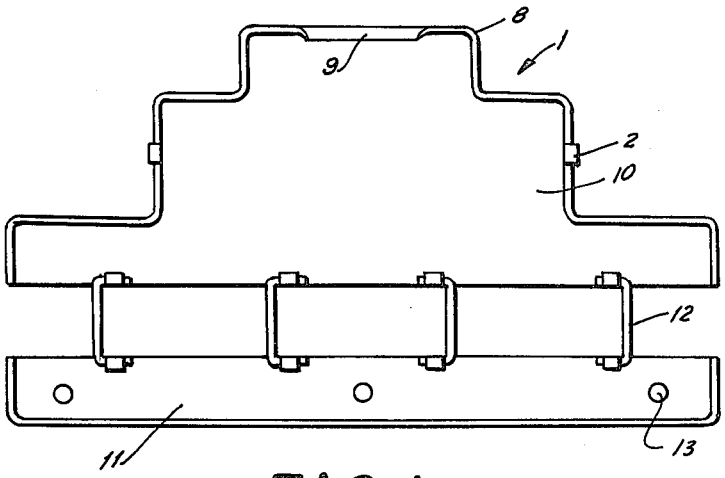
FIG. 1 is a view showing a bottom plate for a carpet power cleaner.

FIG. 1 shows a so-called bottom plate for a lower side, which lies against a housing and is mounted on the latter. The bottom plate 1 has a first plate portion 10 and a second plate portion 11 which are movably connected with each other by wire crossbars 12. Detents 2 are provided on the first plate portion 10 and are of one piece with the latter. A flanging 9 is also formed at a rear edge 8 of the first plate portion 10. The second plate portion 11 has three holes 13 with the aid of which the portion 11 is mounted by screws 14.

Figure 2:
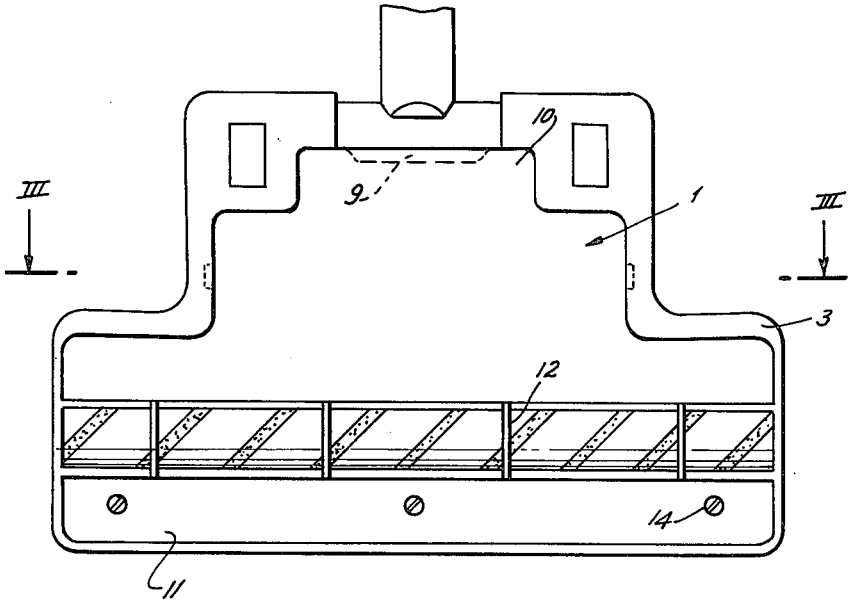
FIG. 2 is a view showing a carpet power cleaner from below with the inventive bottom plate arranged thereon.

FIG. 2 shows mounting of the bottom plate 1 on a carpet power cleaner 3. The second plate portion 11 is mounted by the screws 14 on a housing 3 of the carpet power cleaner. The first plate portion 10 is movably connected with the second plate portion 11 by the wire crossbars 12 and engages by its detents 2 in the housing 3 of the carpet power cleaner.

In order to replace, for example, a round brush 15, the bottom plate 1 must be removed. This can be performed in the following manner. The user pulls out the inwardly extending flanging 9 and disengages the first plate portion 10. The first plate portion 10 can be hinged down with the aid of the wire crossbars 12, while being retained on the device, because the second plate portion 11 is fixedly connected with the housing of the carpet power cleaner by the screws 3. It is also advantageous when, for example, the wire crossbars 12 are fixed, whereas instead of the screws 14 the detents 2 are provided. In the latter case the bottom plate 1 can be completely removed.

Figure 3:
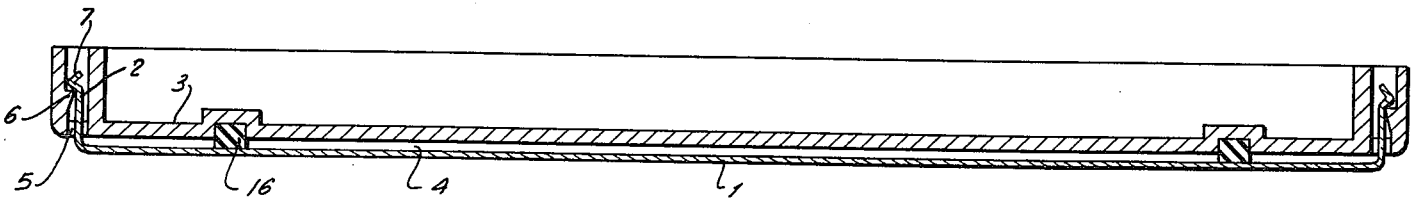
FIG. 3 is a view showing a section taken along line III—III of FIG. 2.

FIG. 3 is a section of FIG. 2 and shows the engagement of the detents 2 with the housing 3 of the carpet power cleaner. The housing 3 of the carpet power cleaner has slots 5 in its lower section 4. The detents 2 extend through the slots 5. Detent edges 6 are provided behind the slots 5, and the detents 2 engage with their bent end sections 7 behind the detent edges 6. Thereby, the detents 2 engage with the housing 3 of the carpet power cleaner.

Seals 16 are further provided in the housing 3 of the carpet power cleaner. The bottom plate 1 abuts against these seals 16. Because of the inclined position of the bent end sections 7, the detents 2 can be released by pulling the flanging 9.

It will be understood that each of the elements described above, or two or more together, may also find a useful application in other types of constructions differing from the types described above.

While the invention has been illustrated and described as embodied in a bottom plate for a carpet power cleaner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A bottom plate for a carpet power cleaner having a housing and a brush arranged in the housing, the bottom plate comprising a body part including two portions which are spaced from one another, one of said portions being attached to the housing, whereas the other of said portions is provided with a detent which is detachably engageable in the housing; and a plurality of transverse bar members extending between and connecting said two portions with one another and guiding the brush, said transverse members being pivotally connected to said body part, so that said other portion, after being disengaged from the housing, can be turned together with said transverse member relative to said one portion to allow removal of the brush without detachement of said one portion and thereby without detachment of the whole body part from the housing.

2. A bottom plate as defined in claim 1, wherein said body part has a rear edge provided with inwardly extending flanging.

3. A bottom plate as defined in claim 1, wherein said one portion of said body part is also provided with a detent which is detachably engageable in the housing.

4. A bottom plate as defined in claim 1, wherein said transverse members are formed by wire crossbars.

5. A bottom plate as defined in claim 1, wherein said other portion of said body part is provided with a plurality of such detents.

6. A bottom plate as defined in claim 5, wherein said detents are of one piece with said body part.

7. A bottom plate as defined in claim 5, wherein the housing has a lower wall and slots provided in the latter, said detents projecting from said body part and arranged to extend through the slots of the lower wall of the housing so as to engage with the latter.

8. A bottom plate as defined in claim 7, wherein the housing has detent edges located behind the slots, each of said detents having a bent end section engageable with a respective one of the detent edges of the housing.

9. A carpet power cleaner, comprising a housing; a brush arranged in the housing; and bottom plate having a body part including two portions which are spaced from one another, one of said portions being attached to said housing, whereas the other of said portions is provided with a detent which is detachably engageable in said housing, said body part also including a plurality of transverse bar members extending between and connecting said two portions of said body part with one another and guiding the brush, said transverse members being pivotally connected to said body part, so that said other portion of said body part after being disengaged from said housing can be turned together with said transverse member relative to said one portion of said body part to allow removal of said brush without detachement of said one portion and thereby without detachment of the whole body part from said housing.

* * * * *